US006382152B2

(12) United States Patent
Pierik

(10) Patent No.: US 6,382,152 B2
(45) Date of Patent: May 7, 2002

(54) CRANK GEAR VARIABLE VALVE ACTUATING MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/792,673

(22) Filed: Feb. 23, 2001

Related U.S. Application Data

(60) Provisional application No. 60/184,356, filed on Feb. 23, 2000.

(51) Int. Cl.[7] ..... F01L 13/00

(52) U.S. Cl. ..... 123/90.16; 123/90.17; 123/90.6

(58) Field of Search ..... 123/90.15, 90.16, 123/90.17, 90.22, 90.31, 90.6

(56) References Cited

U.S. PATENT DOCUMENTS 5,365,895 A * 11/1994 Riley ..... 123/90.16
5,937,809 A * 8/1999 Pierik et al. ..... 123/90.16
6,019,076 A * 2/2000 Pierik et al. ..... 123/90.16
6,041,746 A * 3/2000 Takemura et al. ..... 123/90.16

* cited by examiner

*Primary Examiner*—Weilun Lo
(74) *Attorney, Agent, or Firm*—John VanOphem

(57) ABSTRACT

A variable valve actuating mechanism includes a rocker having a central rocker axis that is substantially parallel with and spaced apart from a central axis of a rotary input shaft. A frame member has a first end configured for being pivotally mounted upon the input shaft and a second end pivotally carrying the rocker. A connecting rod has a first end configured for engaging an eccentric of the rotary input shaft and a second end pivotally attached to the rocker. The connecting rod transfers rotation of the input shaft to oscillation of the rocker relative to the rocker central axis. An output cam is configured for being pivotally mounted upon the input shaft. An output cam gear is affixed to the output cam. A crank gear is affixed to the rocker and engages the output cam gear.

13 Claims, 3 Drawing Sheets

CRANK GEAR VARIABLE VALVE ACTUATING MECHANISM

CROSS-REFERENCE TO RELATED APPLICATIONS

This application claims the benefit of U.S. Provisional Patent Application Ser. No. 60/184,356, filed Feb. 23, 2000.

TECHNICAL FIELD

The present invention relates to variable valve mechanisms.

BACKGROUND OF THE INVENTION

Variable valve actuating (VVA) mechanisms enable the variation of the timing, lift and duration (i.e., the valve lift profile) of associated valves, such as, for example, the valves of an internal combustion engine. Two examples of variable valve actuating mechanisms are detailed in commonly-assigned U.S. Pat. Nos. 5,937,809 and 6,019,076, the disclosures of which are incorporated herein by reference.

As related to internal combustion engines, conventional VVA mechanisms are associated with a cam or input shaft of the engine. More particularly, a conventional VVA mechanism typically includes a roller that engages an input cam of the input shaft or the engine camshaft. One or more link or rocker arms carry and link the roller to an output cam. Rotation of the input cam displaces the roller to create oscillatory movement of the components coupled thereto, such as link or rocker arms, relative to the central axis of the input shaft or camshaft. The oscillatory movement of the components that are coupled to the roller, in turn, directly or indirectly oscillate an output cam and thereby actuate one or more valves of the engine.

A biasing means, such as one or more return springs, is generally required in order to maintain the roller in contact with the rotating input cam in order to reduce mechanical lash. The use of return springs, however, negatively impacts the durability and limits the operating range of conventional VVA mechanisms, thereby limiting the range of engine operation speeds over which the VVA mechanism can be effectively utilized. In addition to return springs, conventional VVA mechanisms typically include numerous other component parts, such as link arms, joints, pins and frames, and are thus relatively complex mechanically. The numerous component parts increase the cost of the mechanism and make the mechanism more difficult to assemble and manufacture.

Many of these numerous component parts are directly or indirectly coupled to the roller, and are therefore caused to pivot relative to the central axis of the input shaft as the input cam displaces the roller. Each of these components parts increase the mass of the structure which undergoes pivotal movement, and thereby further limits the range of engine operation speeds over which the variable valve mechanism can be used. The joints and pins that interconnect the component parts of a conventional variable valve mechanism are subject to interfacial frictional forces that negatively impact durability and efficiency of the mechanism. The link or rocker arms that carry and/or connect the roller of the mechanism with the output cam of the VVA mechanism increase the size of the VVA mechanism, and thus a larger space is required in order to install the VVA mechanism within the engine.

Therefore, what is needed in the art is a variable valve mechanism having fewer component parts.

Furthermore, what is needed in the art is a variable valve mechanism with fewer joints and/or pins, and thus has reduced frictional losses.

Still further, what is needed in the art is a variable valve mechanism that eliminates the use of return springs, and is therefore operable over an increased range of engine operating speeds.

Moreover, what is needed in the art is a variable valve mechanism that has reduced pivoting mass, and is therefore operable over an increased range of engine operating speeds.

SUMMARY OF THE INVENTION

The present invention provides a crank gear variable valve actuating mechanism.

The invention comprises, in one form thereof, a rocker having a central rocker axis that is substantially parallel with and spaced apart from a central axis of a rotary input shaft. A frame member has a first end configured for being pivotally mounted upon the input shaft and a second end pivotally carrying the rocker. A connecting rod has a first end configured for engaging an eccentric of the rotary input shaft and a second end pivotally attached to the rocker. The connecting rod transfers rotation of the input shaft to oscillation of the rocker relative to the rocker central axis. An output cam is configured for being pivotally mounted upon the input shaft. An output cam gear is affixed to the output cam. A crank gear is affixed to the rocker and engages the output cam gear.

An advantage of the present invention is that it uses fewer component parts relative to a conventional variable valve mechanism, thereby reducing the cost and complexity of the mechanism.

Another advantage of the present invention is that fewer joints/pins are necessary relative to a conventional variable valve mechanism, thereby reducing frictional losses and increasing durability of the mechanism.

A still further advantage of the present invention is that return springs are not required, thereby further increasing the durability of the mechanism and enabling use of the mechanism over a wider range of engine operating conditions.

An even further advantage of the present invention is that the pivoting mass is substantially reduced, thereby rendering the mechanism operable over a wider range of engine operating speeds.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
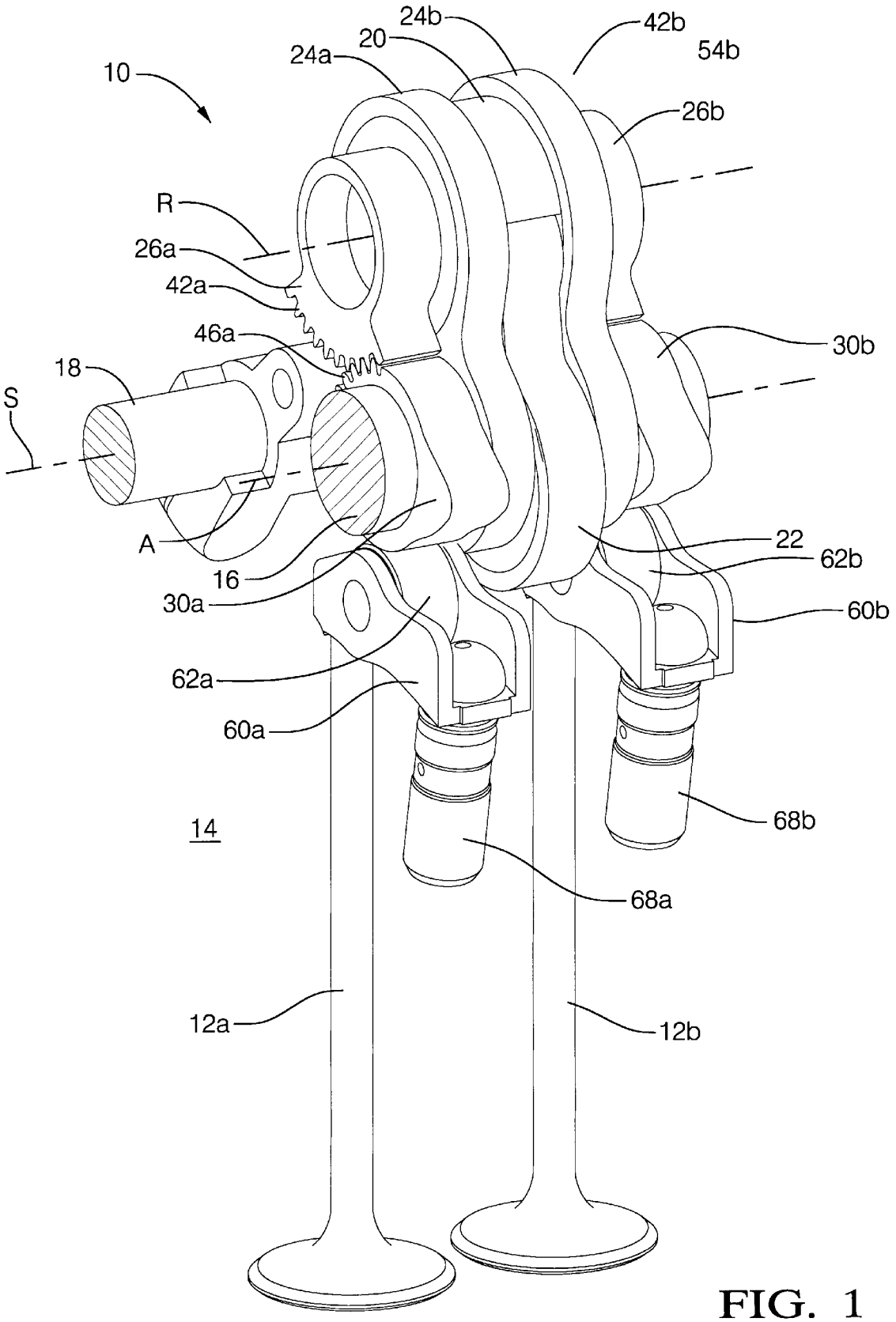
FIG. 1 is a perspective view of one embodiment of a crank gear variable valve actuating mechanism of the present invention.
Figure 2:
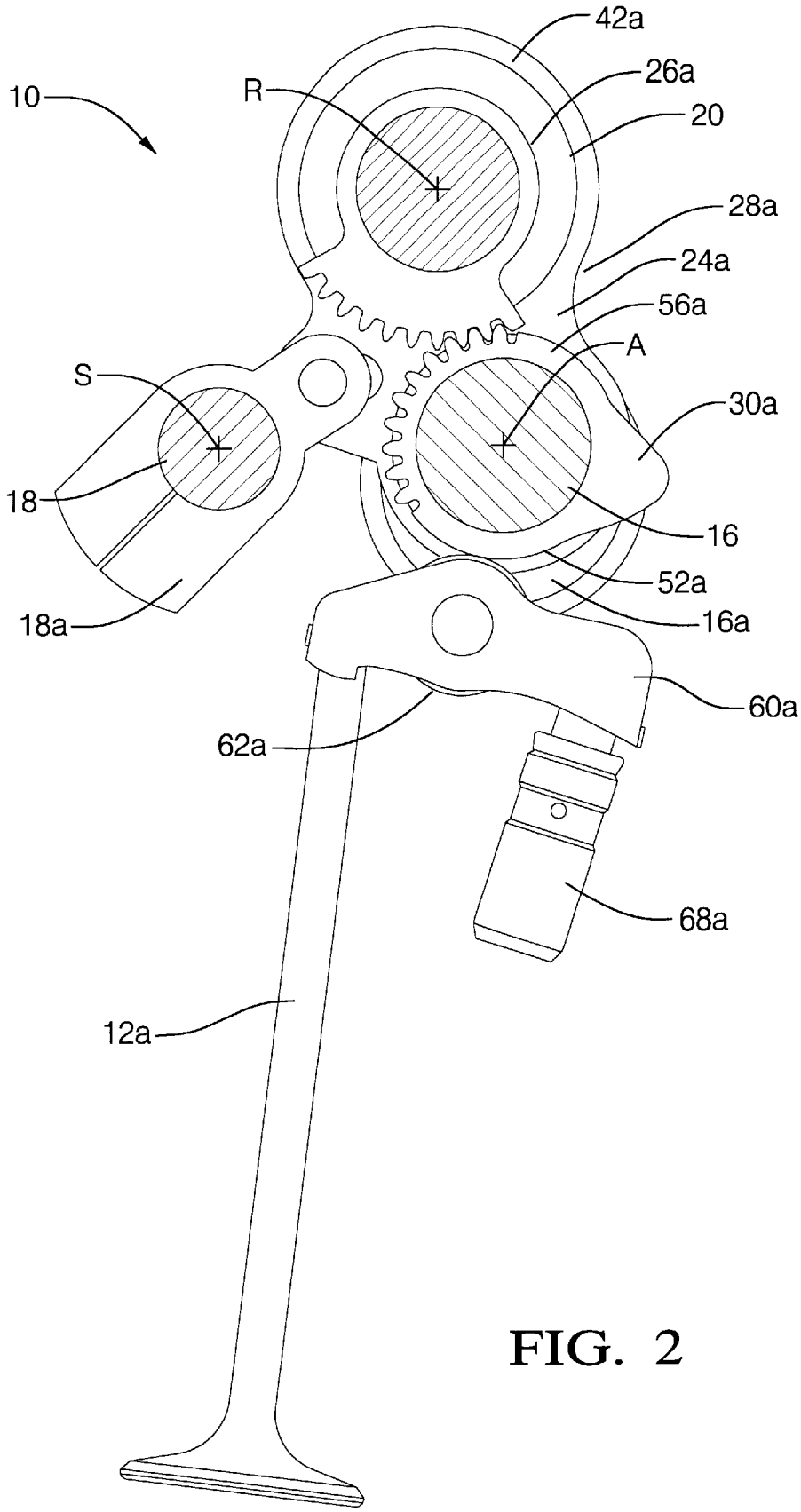
FIG. 2 is an end view of the crank gear variable valve actuating mechanism of FIG. 1.

Referring now to the drawings, and particularly to FIGS. 1 and 2, there is shown one embodiment of a crank gear variable valve actuating (VVA) mechanism of the present invention. Generally, and as will be more particularly described hereinafter, VVA mechanism 10 is operably associated with valves 12*a*, 12*b* of internal combustion engine 14 and with rotary input shaft 16. Control shaft 18 is pivoted to selectively vary the timing, duration and lift, i.e., the valve lift profile, of valves 12*a*, 12*b*. VVA 10 includes rocker 20, connecting rod 22, frame members 24*a*, 24*b*, crank gears 26*a*, 26*b* and output cams 30*a*, 30*b*.

Rotary input shaft 16 is an elongate shaft member, such as, for example, a crankshaft of engine 14. Input shaft 16 has central axis A, and is rotated three-hundred and sixty degrees (360 degrees) about central axis A. Input shaft 16 is driven to rotate in timed relation to the engine crankshaft (not shown), such as, for example, by a camshaft drive, chain, or other suitable means. Input shaft 16 extends the length of the cylinder head (not shown) of multi-cylinder engine 14. A single VVA mechanism 10 is associated with each cylinder of engine 14. Input shaft 16 includes input eccentric 16*a* (FIG. 3), which rotates as substantially one body with input shaft 16. Input eccentric 16*a* is, for example, affixed to or integral with input shaft 16.

Control shaft 18 is selectively pivoted, such as, for example, by an actuator subassembly (not shown) to establish the lift profile of valves 12*a*, 12*b*, as will be more particularly described hereinafter. Control shaft 18 pivots relative to shaft axis S, which is substantially parallel with and spaced apart from central axis A of input shaft 16. Control shaft 18 is coupled to each of frame members 24*a*, 24*b* by respective shaft couplers 18*a*, 18*b* (only one shown), such as, for example, shaft clamps, such that pivotal movement of control shaft 18 relative to shaft axis S is transferred to pivoting of frame members 24*a*, 24*b* relative to central axis A.

Figure 3:
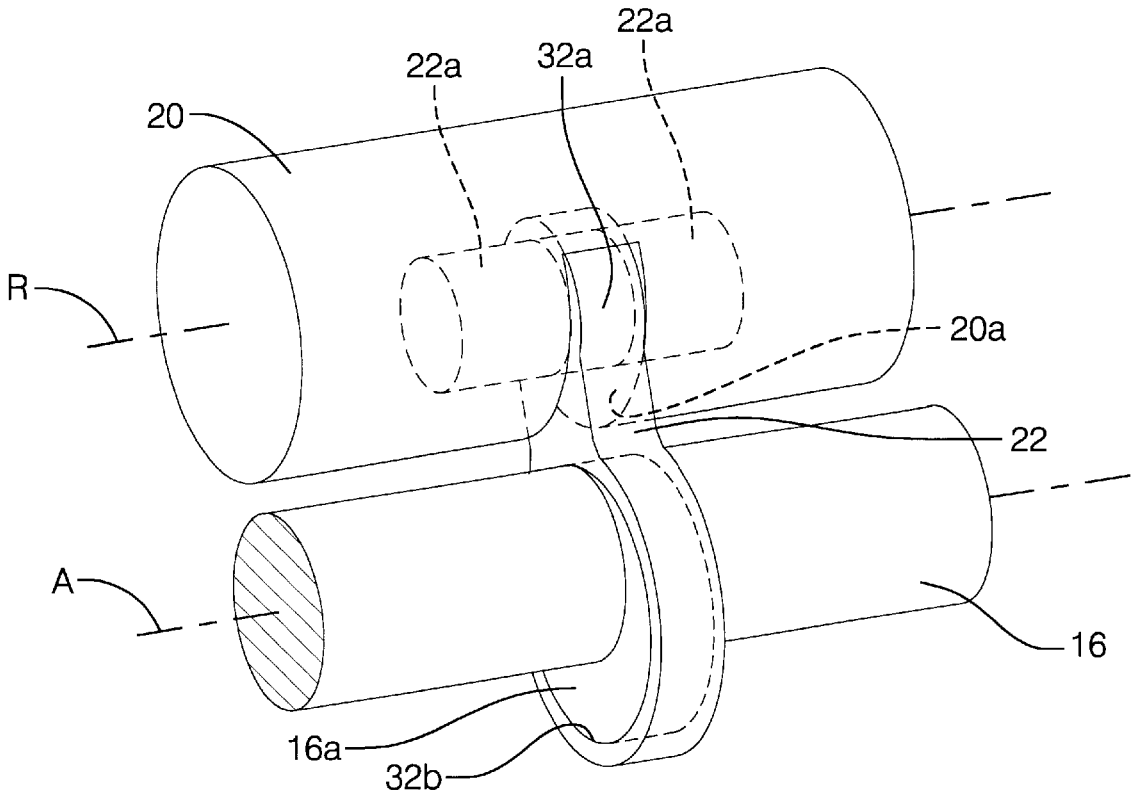
FIG. 3 is a detail view of the connecting rod and rocker of FIG. 1.

Rocker 20 is an elongate cylindrical member having central axis R. Central axis R is substantially parallel with and spaced apart from central axis A of input shaft 16. Referring now to FIG. 3, rocker 20 defines notched or recessed section 20*a*. A first end (not referenced) of connecting rod 22 is pivotally coupled by rod coupler 22*a*, such as, for example, a pin or peg, to rocker 20 at notch section 20*a*. Rocker 20 is pivotally carried by each of frame members 24*a*, 24*b*, such that pivotal movement of frame members 24*a*, 24*b* relative to central axis A results in the pivoting of rocker 20 relative to central axis A. Rocker 20 is free to pivot within and relative to each of frame members 24*a*, 24*b* and about its own central axis R. Crank gears 26*a*, 26*b* are affixed to rocker 20 at opposite ends thereof.

Connecting rod 22 is an elongate arm member that is pivotally coupled at a first end to rocker 20 and at the opposite end to eccentric 16*a* of input shaft 16. More particularly, first end (not referenced) of connecting rod 22 defines orifice 32*a* (see FIG. 3) therethrough, within which is received at least a portion of rod coupler 22*a* to thereby pivotally couple connecting rod 22 to rocker 20. A second end (not referenced) of connecting rod 22 defines orifice 32*b* therethrough, within which is disposed at least a portion of eccentric 16*a* to thereby couple connecting rod 22 to input shaft 16. Connecting rod 22 transfers rotation of input shaft 16 and eccentric 16*a* to oscillatory movement of rocker 20 within frame members 24*a*, 24*b* and about rocker axis R. Input eccentric 16*a* is configured to impart a fixed range or degree of oscillation, such as, for example, forty-five (45) degrees, to rocker 20.

Frame members 24*a*, 24*b* are substantially identical. As best shown in FIG. 2, wherein only frame member 24*a* is shown for the sake of clarity, each of frame members 24*a*, 24*b* define a respective frame rocker orifice 36*a*, 36*b* and a respective frame shaft orifice 38*a*, 38*b*. Each frame rocker orifice 36*a*, 36*b* receives a corresponding portion of rocker 20 to thereby pivotally associate frame members 24*a*, 24*b* and rocker 20 such that rocker 20 is free to undergo oscillatory movement relative to frame members 24*a*, 24*b* and about rocker axis R, and be carried by frame members 24*a*, 24*b* during pivotal movement thereof relative to central axis A of input shaft 16. Each frame shaft orifice 38*a*, 38*b* receives a corresponding portion of input shaft 16 to thereby pivotally associate frame members 24*a*, 24*b* and input shaft 16 such that frame members 24*a*, 24*b* are free to pivot relative to central axis A and yet are not rotated by the rotation of input shaft 16. Frame member 24*a* is disposed on a first side (not referenced) of connecting rod 22 while frame member 24*b* is disposed on the opposite side of connecting rod 22.

Crank gears 26*a*, 26*b* are disposed on opposite ends of rocker 20 and are substantially concentric relative to central axis R thereof. More particularly, crank gear 26*a* is disposed upon a first end of rocker 20 generally adjacent frame member 24*a* and crank gear 26*b* is disposed upon a second end of rocker 20 generally adjacent frame member 24*b*. Each crank gear 26*a*, 26*b* is affixed, such as, for example welded, bolted or otherwise secured by suitable means, to rocker 20. Alternatively, each crank gear 26*a*, 26*b* is formed integrally and/or monolithically with rocker 20. At least a portion of the outer surfaces (not referenced) of crank gears 26*a*, 26*b* include crank gear teeth 42*a*, 42*b* (only one shown), respectively.

Output cams 30*a*, 30*b* are pivotally mounted upon input shaft 16, generally adjacent a respective frame member 24*a*, 24*b*. Output cams 30*a*, 30*b* are not rotated by rotation of input shaft 16, but are rather free to pivot relative to central axis A thereof. Output cams 30*a*, 30*b* each include on a portion of the outside surfaces thereof cam gear teeth 46*a*, 46*b* (only one shown), which mesh with crank gear teeth 42*a*, 42*b*, respectively, of a corresponding crank gear 26*a*, 26*b*. Each of output cams 30*a*, 30*b* is associated with a respective roller finger follower (RFF) 60*a*, 60*b*. More particularly, the outer surface (not referenced) of output cams 30*a*, 30*b* engage rollers 62*a*, 62*b*, respectively, of a corresponding RFF 60*a*, 60*b*. As will be known to those skilled in the art, the outer surfaces of output cams 30*a*, 30*b* define a lift profile which includes a base circle portion and a lift portion (neither of which is referenced).

In use, valves 12*a*, 12*b* are actuated by VVA mechanism 10 in accordance with the lift profile of the portion of the outer surfaces of output cams 30*a*, 30*b* that engage rollers 62*a*, 62*b*, respectively, as output cams 30*a*, 30*b* are oscillated through a predetermined range of oscillation. The oscillation of output cams 30*a*, 30*b*, and the portion of the outer surfaces thereof that engage rollers 62*a*, 62*b*, respectively, cause RFFs 60*a*, 60*b* to pivot about lash adjusters 68*a*, 68*b*, respectively, and actuate a corresponding one of valves 12*a*, 12*b*.

More particularly, and as stated above, input shaft 16 is driven to rotate relative to central axis A thereof in timed relation to the crankshaft (not shown) of engine 14. Connecting rod 22 transfers rotation of input shaft 16 and eccentric 16*a* to oscillatory movement of rocker 20 within frame members 24*a*, 24*b* and relative to central axis R. Input eccentric 16*a* is configured to impart to rocker 20 a fixed range or degree of oscillation, such as, for example, forty-five (45) degrees. Crank gears 26*a*, 26*b* are affixed to rocker 20, and thus oscillate as substantially one body with rocker 20. Pivotal oscillation of crank gears 26*a*, 26*b*, in turn, is transferred by output cam gear teeth 46*a*, 46*b* to pivotal oscillation of output cams 30*a*, 30*b*. As output cams 30*a*, 30*b* pivotally oscillate, a portion of the lift profiles thereof engage rollers 62*a*, 62*b*, respectively, of a corresponding RFF 60*a*, 60*b*. The portion of the lift profiles of output cams 30*a*, 30*b* that engage rollers 62*a*, 62*b*, respectively, determines the valve lift profile of valves 12*a*, 12*b*.

The valve lift profiles of valves 12*a*, 12*b* is selected and varied dependent at least in part upon the angular position of control shaft 18. More particularly, the portion of the lift profiles of output cams 30*a*, 30*b* that engage rollers 62*a*, 62*b*, respectively, and thereby determine the valve lift profile of valves 12*a*, 12*b* is selected and varied dependent at least in part upon the angular position of control shaft 18. As stated above, control shaft 18 is coupled by shaft couplers 18*a*, 18*b* to frame members 24*a*, 24*b*, respectively. Thus, as control shaft 18 is pivoted relative to central axis S thereof frame members 24*a*, 24*b* are, in turn, pivoted relative to central axis A of input shaft 16. Frame members 24*a*, 24*b* carry rocker 20, and thus the pivoting of frame members 24*a*, 24*b* relative to central axis A pivots center axis R of rocker 20 relative to central axis A of input shaft 16. Crank gears 26*a*, 26*b* are affixed to and carried by rocker 20, and thus pivot with rocker 20 relative to central axis A of input shaft 16. The pivoting of crank gears 26*a*, 26*b* relative to central axis A is transferred to pivoting of output cams 30*a*, 30*b* relative to central axis A by output cam gear teeth 46*a*, 46*b*, respectively, which mesh with crank gear teeth 42*a*, 42*b*, respectively, of a corresponding crank gear 26*a*, 26*b*.

More particularly, and for example, as control shaft 18 is pivoted clockwise relative to central axis S thereof frame members 24*a*, 24*b* and rocker 20 are pivoted counterclockwise relative to central axis A of input shaft 16. Crank gears 26*a*, 26*b* are affixed to and carried by rocker 20, and are thus also pivoted counter-clockwise relative to central axis A. Crank gear teeth 42*a*, 42*b*, which are meshed with output cam gear teeth 46*a*, 46*b*, respectively, transfer the counter-clockwise pivoting of crank gears 26*a*, 26*b* to counterclockwise pivoting of output cams 30*a*, 30*b*, respectively. The pivoting of output cams 30*a*, 30*b* establishes the angular position of output cams 30*a*, 30*b* relative to central axis A. The angular position of output cams 30*a*, 30*b* determines the portion of the lift profile thereof that engages rollers 62*a*, 62*b* during the fixed angular range of oscillation of output cams 30*a*, 30*b*. Thus, the angular position of control shaft 18 relative to central axis S thereof determines the angular relation of output cams 30*a*, 30*b* relative to central axis A and relative to rollers 62*a*, 62*b* of RFFs 60*a*, 60*b*, respectively, thereby determining the valve lift profile of valves 12*a*, 12*b*.

For example, a relatively high amount of valve lift is obtained by placing the lift portion of the lift profile of output cams 30*a*, 30*b* well within the fixed angular range of oscillation thereof relative to rollers 62*a*, 62*b*, respectively. Thus, as output cams 30*a*, 30*b* are oscillated, at least a substantial portion of the lift portion of the lift profile thereof engages rollers 62*a*, 62*b*, respectively, and impart a correspondingly high amount of lift to valves 12*a*, 12*b*. Conversely and as a second example a relatively low amount of or substantially no valve lift is obtained by placing the lift portion of the lift profile of output cams 30*a*, 30*b* only partially within or substantially entirely outside the fixed angular range of oscillation thereof relative to rollers 62*a*, 62*b*, respectively. Thus, as output cams 30*a*, 30*b* are oscillated, only a small portion of the lift portion or only the base circle portion of the lift profile thereof engages rollers 62*a*, 62*b*, respectively, and impart a correspondingly small amount of lift to valves 12*a*, 12*b*.

It should be particularly noted that as control shaft 18 is pivoted relative to central axis S thereof, thereby causing frame members 24*a*, 24*b* and central axis R of rocker 20 to pivot relative to central axis A, rocker 20 also pivots relative to its own center axis R within frame members 24*a*, 24*b*. With input shaft 16 rotating, for example, in a clockwise direction, the pivoting of rocker 20 relative to its center axis R advances the timing of the actuation of valves 12*a*, 12*b* with VVA mechanism 10 in a low-lift position relative to the timing of the actuation of valves 12*a*, 12*b* with VVA mechanism 10 in a high-lift position.

In the embodiment shown, output cam gear teeth 46*a*, 46*b* and crank gears 26*a*, 26*b* are configured as spur gears. However, it is to be understood that VVA mechanism 10 can be alternately configured, such as, for example, helical gears or other suitable types of gears.

In the embodiment shown, VVA mechanism 10 is configured without means for lash adjustment. However, it is to be understood that VVA mechanism 10 can be alternately configured to include lash adjustment means, such as, for example, the lash adjustment means disclosed in commonly-assigned U.S. Pat. No. 5,680,836, entitled PLANETARY CAM PHASER WITH LASH COMPENSATION, the disclosure of which is incorporated herein by reference. Further illustrating a lash adjustment means for use with a variable valve mechanism is commonly-assigned U.S. patent application Ser. No. 09/791,313, filed Feb. 22, 2001, and entitled RING GEAR VARIABLE VALVE TRAIN DEVICE, the disclosure of which is also incorporated herein by reference.

In the embodiment shown, VVA mechanism 10 includes two frame members 24*a*, 24*b* and two output cams 30*a*, 30*b*, to thereby actuate dual inlet valves 12*a*, 12*b* of a corresponding cylinder of engine 14. However, it is to be understood that VVA mechanism 10 can be alternately configured, such as, for example, for use with a cylinder having only one inlet valve. In this embodiment, the VVA mechanism includes a single frame member and a single output cam.

In the embodiment shown, a single VVA mechanism 10 is associated with one cylinder (not shown) of engine 14. However, it is to be understood that multiple VVA mechanisms of the present invention can be associated with each cylinder of an engine to thereby variably actuate the intake and/or exhaust valves of that cylinder.

In the embodiment shown, frame members 24*a*, 24*b* are pivotally mounted upon input shaft 16. However, it is to be understood that VVA mechanism 10 can be alternately configured, such as, for example, with frame members mounted to a secondary shaft or other structure and being configured for pivotal movement relative to the central axis of the input shaft or relative to a central axis of the secondary shaft.

In the embodiment shown, VVA mechanism 10 is configured for use with an internal combustion engine. However, it is to be understood that VVA mechanism 10 can be alternately configured, such as, for example, for use with various other mechanisms or machinery which may advantageously utilize variable displacement, duration and/or timing of one or more moving components.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A variable valve mechanism, comprising:

a rocker having a central rocker axis, said central rocker axis being substantially parallel with and spaced apart from a central axis of a rotary input shaft;

at least one frame member having a first end and a second end, said first end configured for being pivotally mounted upon the input shaft, said second end pivotally carrying said rocker;

a connecting rod having a first end and a second end, said first end configured for engaging an eccentric of the rotary input shaft, said second end pivotally attached to said rocker, said connecting rod configured for transferring rotation of the input shaft to oscillation of said rocker relative to said rocker central axis;

at least one output cam configured for being pivotally mounted upon the input shaft;

an output cam gear affixed to each of said at least one output cam; and at least one crank gear, each of said at least one crank gear affixed to said rocker and engaging a corresponding said output cam gear.

2. The variable valve mechanism of claim 1, further comprising a control shaft pivotable about a central shaft axis, said central shaft axis being substantially parallel with and spaced apart from the central axis of the input shaft, said control shaft being pivotally coupled to each of said at least one frame member.

3. The variable valve mechanism of claim 1, wherein said at least one crank gear is integral with said rocker.

4. The variable valve mechanism of claim 1, wherein each said output cam gear is integral with a corresponding one of said at least one output cam.

5. The variable valve mechanism of claim 1, where each said output cam gear comprises a spur gear.

6. The variable valve mechanism of claim 1, wherein each of said at least one crank gear comprises a spur gear.

7. A variable valve mechanism, comprising:

an input shaft having a central axis, an eccentric disposed on said input shaft;

a rocker having a central rocker axis, said central rocker axis being substantially parallel with and spaced apart from said central axis of said rotary input shaft;

at least one frame member having a first end and a second end, said first end pivotally mounted upon said input shaft, said second end pivotally carrying said rocker;

a connecting rod having a first end and a second end, said first end engaging said eccentric, said second end pivotally attached to said rocker, said connecting rod transferring rotation of said input shaft to oscillation of said rocker relative to said rocker central axis;

at least one output cam pivotally mounted upon said input shaft, an output cam gear affixed to each of said at least one output cam; and at least one crank gear, each of said at least one crank gear affixed to said rocker and engaging a corresponding said output cam gear.

8. The variable valve mechanism of claim 7, further comprising a control shaft pivotable about a central shaft axis, said central shaft axis being substantially parallel with and spaced apart from said central axis of said input shaft, said control shaft being pivotally coupled to each of said at least one frame member.

9. The variable valve mechanism of claim 7, wherein said at least one crank gear is integral with said rocker.

10. The variable valve mechanism of claim 7, wherein each said output cam gear is integral with a corresponding one of said at least one output cam.

11. The variable valve mechanism of claim 7, where each of said output cam gear comprises a spur gear.

12. The variable valve mechanism of claim 7, wherein each of said at least one crank gear comprises a spur gear.

13. An internal combustion engine, comprising:

a variable valve mechanism, including:

an input shaft having a central axis, an eccentric disposed on said input shaft;

a rocker having a central rocker axis, said central rocker axis being substantially parallel with and spaced apart from said central axis of said rotary input shaft;

at least one frame member having a first end and a second end, said first end pivotally mounted upon said input shaft, said second end pivotally carrying said rocker;

a connecting rod having a first end and a second end, said first end engaging said eccentric, said second end pivotally attached to said rocker, said connecting rod transferring rotation of said input shaft to oscillation of said rocker relative to said rocker central axis;

at least one output cam pivotally mounted upon said input shaft, an output cam gear affixed to each of said at least one output cam; and at least one crank gear, each of said at least one crank gear affixed to said rocker and engaging a corresponding said output cam gear.

* * * * *